US007013568B2

(12) United States Patent
Schmidt

(10) Patent No.: US 7,013,568 B2
(45) Date of Patent: Mar. 21, 2006

(54) SNAP-TOGETHER EATING UTENSIL ASSEMBLY

(75) Inventor: George Schmidt, Douglaston, NY (US)

(73) Assignee: Creative Bath Products, Inc., Central Islip, NY (US)

( * ) Notice: Subject to any disclaimer, the term of this patent is extended or adjusted under 35 U.S.C. 154(b) by 0 days.

(21) Appl. No.: 10/936,111

(22) Filed: Sep. 8, 2004

(65) Prior Publication Data

US 2005/0278958 A1 Dec. 22, 2005

Related U.S. Application Data

(60) Provisional application No. 60/580,921, filed on Jun. 18, 2004.

(51) Int. Cl.
*A47J 43/28* (2006.01)

(52) U.S. Cl. ..... 30/147; 30/148; 30/149; D7/645

(58) Field of Classification Search ..... 30/142, 30/143, 147, 148, 149, 150; D7/645

See application file for complete search history.

(56) References Cited

U.S. PATENT DOCUMENTS

| | | | | | |
|---|---|---|---|---|---|
| 1,053,387 | A | * | 2/1913 | Hawley | 30/147 |
| 3,032,184 | A | * | 5/1962 | Kuster | 206/340 |
| 4,159,182 | A | * | 6/1979 | Adolfson | 366/343 |
| 4,317,284 | A | | 3/1982 | Prindle | 30/147 |
| 4,377,035 | A | | 3/1983 | Dalichow | 30/147 |
| 4,524,512 | A | | 6/1985 | Formo et al. | 30/147 |
| D284,442 | S | * | 7/1986 | Chan | D7/645 |
| 4,922,611 | A | | 5/1990 | Levy | 30/147 |
| 4,995,154 | A | | 2/1991 | Bamber | 30/147 |
| D347,975 | S | * | 6/1994 | Zeller | D7/645 |
| 5,327,650 | A | | 7/1994 | Rojas | 30/147 |
| D362,160 | S | * | 9/1995 | Brabeck et al. | D7/645 |
| 5,845,403 | A | | 12/1998 | Nivin | 30/147 |
| 5,904,250 | A | * | 5/1999 | De Schutter | 206/553 |

* cited by examiner

*Primary Examiner*—Hwai-Siu Payer
(74) *Attorney, Agent, or Firm*—Gerald E. Hespos; Anthony J. Casella

(57) ABSTRACT

An eating utensil assembly includes a knife, a fork and a spoon. The knife includes an elongate handle, and grooves are formed in opposite surfaces of the handle. The fork and the spoon each have channel-shaped handles that can be nested over the handle of the knife. Additionally, the channel-shaped handles of the fork and spoon have elongate ribs configured for releasable snapped engagement with the grooves in the handle of the knife.

11 Claims, 6 Drawing Sheets

SNAP-TOGETHER EATING UTENSIL ASSEMBLY

This application claims priority on U.S. Provisional Patent Appl. No. 60/580,921, filed Jun. 18, 2004.

BACKGROUND OF THE INVENTION

1. Field of the Invention

The invention relates to eating utensils that can be snapped together for easy handling.

2. Description of the Related Art

Barbecues, picnics, cocktail parties, birthday parties and other social gatherings often require guests to obtain food from a buffet table, a barbecue grill or from a server. The guest typically picks up or is handed a plate, eating utensils and a napkin. The guest then places food on the plate while holding the eating utensils and napkin. The guest then carries the food, the eating utensils and the napkin to a seat. The seat may be at a table, but many guests must balance and manipulate the plate of food, the eating utensils and the napkin on their lap. This entire process is complicated when the guest also must obtain, carry and manipulate a beverage. This cumbersome procedure typically requires the guest to obtain, hold and manipulate a knife, a fork and a spoon. All of these items are long and slender and easily can fall from the grip of the guest while the guest is trying to balance and manipulate a plate full of food, a napkin and a beverage.

The host of such a social gathering also is faced with the task of presenting plates, glassware and eating utensils in a convenient and attractive manner. Some hosts choose to tie the eating utensils together with a ribbon. Others bundle the eating utensils together with the napkin. Both of these processes take time for the host who is undoubtedly trying the prepare food and make other arrangements for a social gathering. Additionally, a ribbon tied around eating utensils may be too loose, and therefore ineffective, or may be too tight and difficult to untie.

Plastic eating utensils offer certain efficiencies for the host and provide a light weight that can facilitate handling of the utensils at a buffet table, grill or other food serving line. However, most plastic utensils are aesthetically unattractive and most plastic eating utensils do not overcome problems associated with the handling of many items while obtaining food at a social gathering.

Attempts have been made to provide eating utensils that can be assembled and disassembled. Such assemblies are shown, for example, in U.S. Pat. No. 5,845,403, U.S. Pat. No. 5,327,650, U.S. Pat. No. 4,995,154 and U.S. Pat. No. 4,922,611. These assemblies, however, typically are aesthetically unattractive and difficult to assemble or disassemble.

Accordingly, an object of the subject invention is to provide an eating utensil assembly that is aesthetically attractive.

It is another object of the subject invention to provide an eating utensil assembly that can be assembled and disassembled with ease.

A further object of the subject invention is to provide an eating utensil assembly that can be handled with ease, both in the assembled condition and the disassembled condition.

SUMMARY OF THE INVENTION

The invention relates to an assembly of eating utensils that can be releasably connected to one another. The assembly includes a first utensil with an elongate handle. The handle preferably is of circular or elliptical cross-section. The assembly further includes second and third utensils each of which has an elongate handle. The handles of the second and third utensils preferably are generally channel-shaped and are configured to be assembled around the handle of the first utensil. The handles of the first, second and third utensils preferably include mounting means for releasably engaging the channel-shaped handles of the second and third utensils around the handle of the first utensil. The mounting means may comprise interengageable grooves and ribs. For example, the handle of the first utensil may be formed with elongate grooves extending along opposite sides of the handle. The handles of the second and third utensils may comprise elongate ribs facing inwardly on the channel-shaped handles. The ribs may be disposed and dimensioned to snap into engagement with the grooves on the handle of the first utensil.

The first, second and third utensils may be formed from a thermoplastic material that exhibits sufficient rigidity and resilient characteristics for snapped engagement of the second and third utensils with the first utensil.

The first utensil preferably is a knife formed with a substantially planar blade and preferably having an array of serrations defining a cutting edge. The plane of the knife blade may be coincident with a plane defined by the releasable engagement means on the handle. The second and third utensils may be a fork and a spoon. The fork and the spoon may have identical or similar handles and ends of the fork and spoon joined to the handles may be similarly configured. More particularly, the fork and the spoon each may have a concave top surface and a convex bottom surface. The concave top surface enables secure retention of food therein. The fork, however, has at least one slit extending generally parallel to the longitudinal direction of the handle so that two tines are defined by the slit. The fork and the spoon each have a top edge that preferably is angled slightly to the plane defined by opposite side edges of the channel-shaped handle. Additionally, the peripheral edges of the fork and the spoon may have a shape similar to the shape of the blade of the knife.

The assembly is used by snapping the handles of the second and third utensils around the handle of the first utensil. More particularly, the generally channel-shaped handles of the fork and spoon may be assembled around the handle of the knife. The ribs on the fork and spoon then may be snapped into engagement with the grooves along the handle of the knife. The assembly of the first through third utensils can be stored, displayed and handled easily in the assembled condition. However, a user merely needs to urge the second and/or third utensils away from one another. Thus, in the preferred embodiment, the fork and/or spoon may be urged away from the knife. Forces for separating the utensils in this manner cause the engagement means to disengage. Thus, the three utensils can be used in a conventional manner. The channel shape of the handles on the second and third utensils provides a large surface area to facilitate gripping and manipulation of the second and third utensils.

The plastic utensils can be discarded after use or can be cleaned, dried and reassembled for subsequent use.

DETAILED DESCRIPTION OF THE PREFERRED EMBODIMENT

Figure 1:
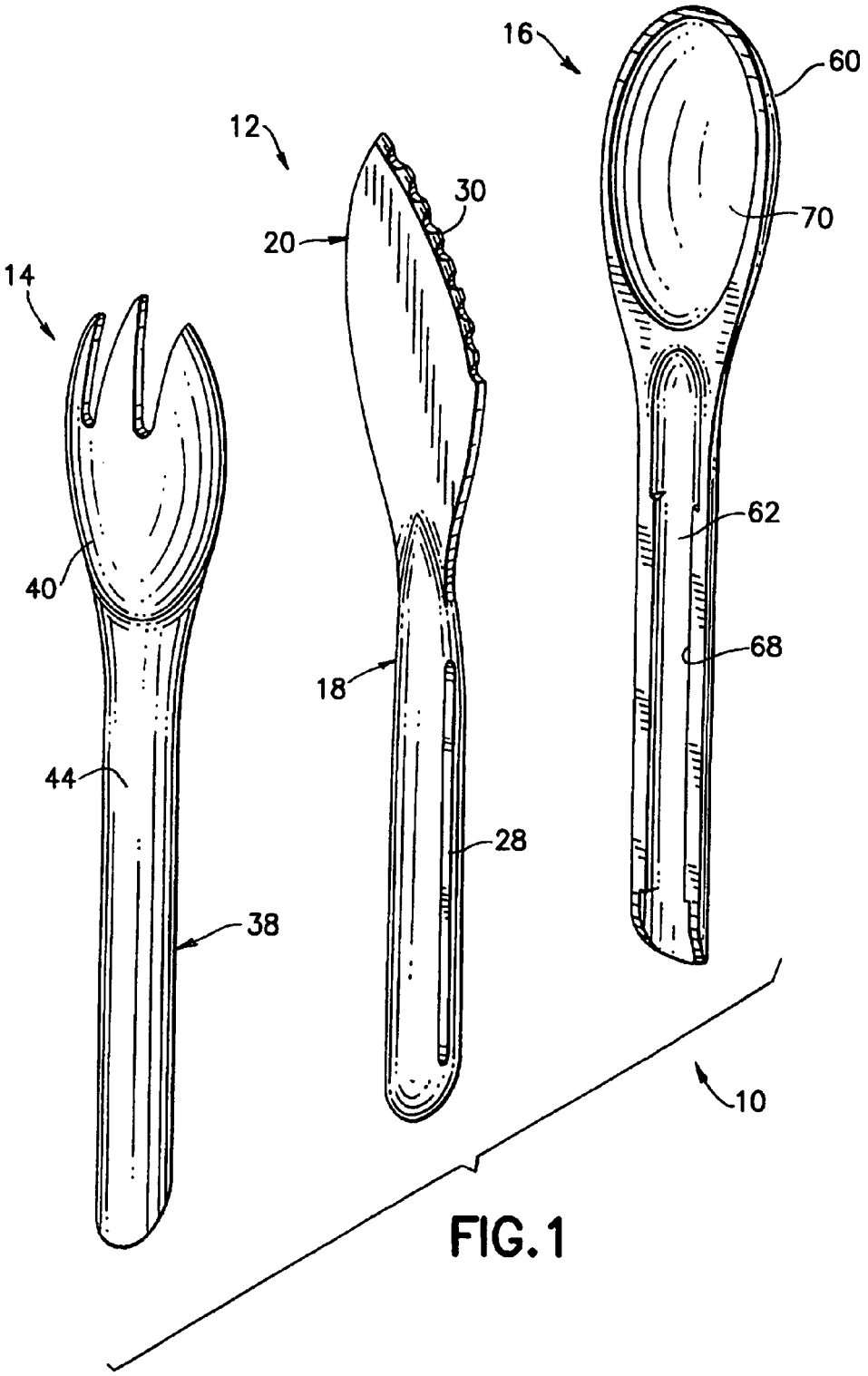
FIG. 1 is an exploded perspective view of an eating utensil assembly in accordance with the subject invention.
Figure 2:
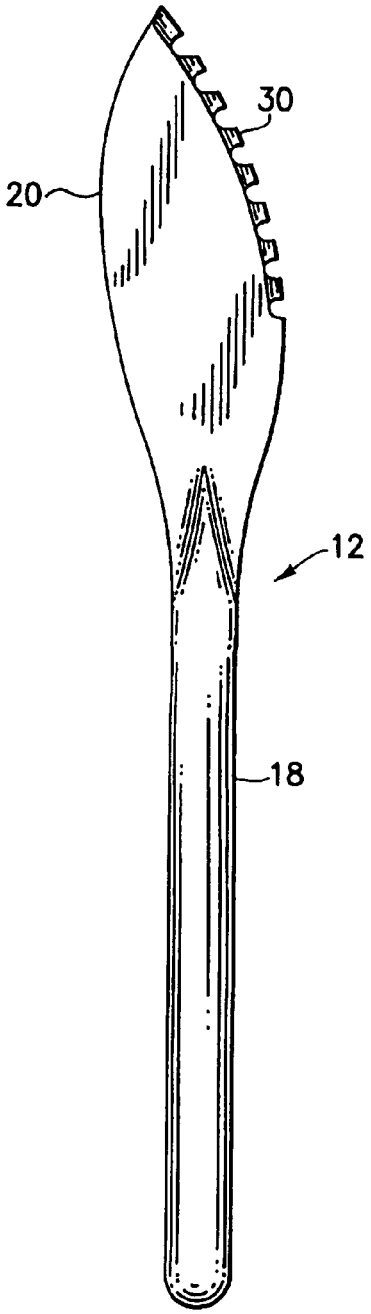
FIG. 2 is a top plan view of the knife of the assembly shown in FIG. 1.
Figure 3:
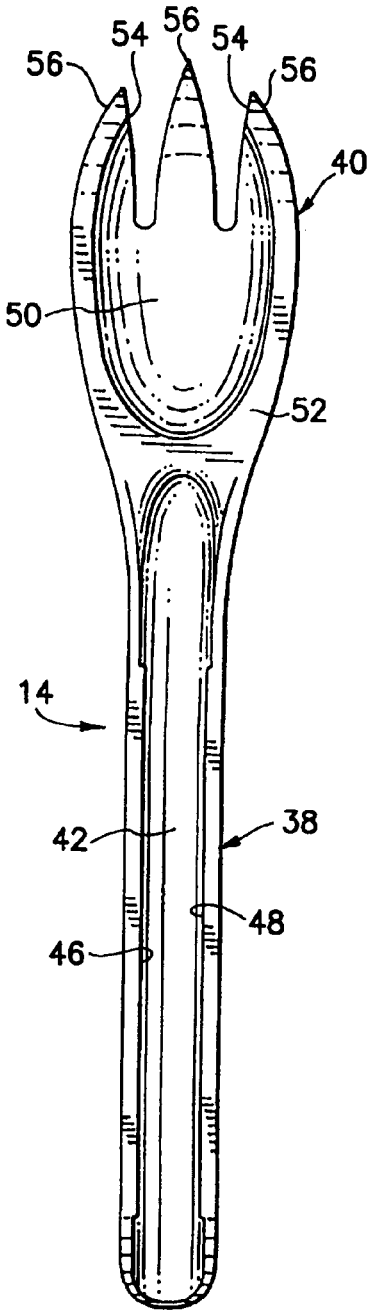
FIG. 3 is a top plan view of the fork of the assembly shown in FIG. 1.
Figure 4:
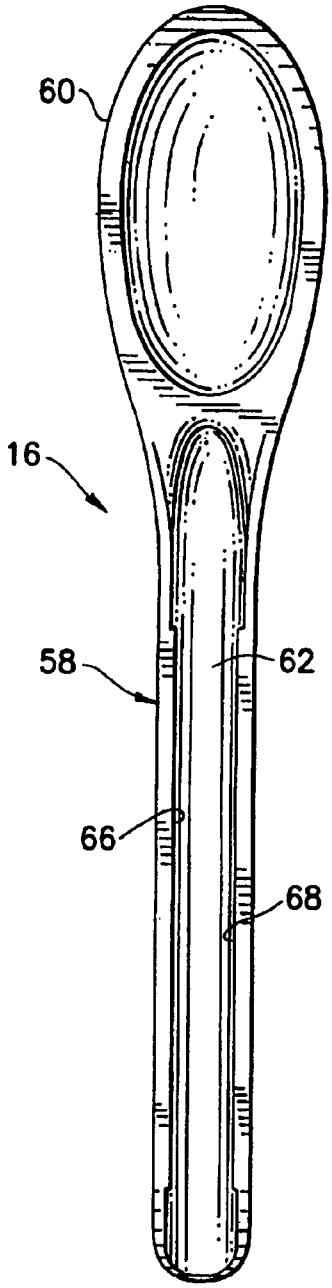
FIG. 4 is a top plan view of the spoon of the assembly shown in FIG. 1.
Figure 5:
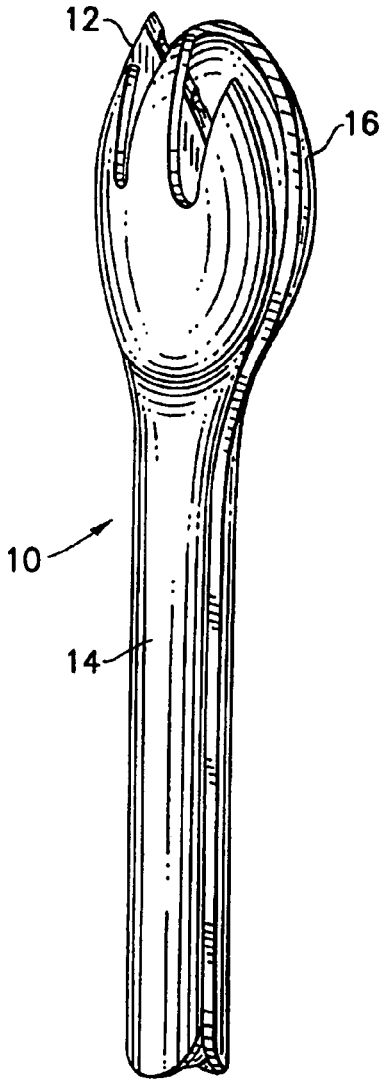
FIG. 5 is a perspective view of the eating utensil assembly in the assembled condition.
Figure 6:
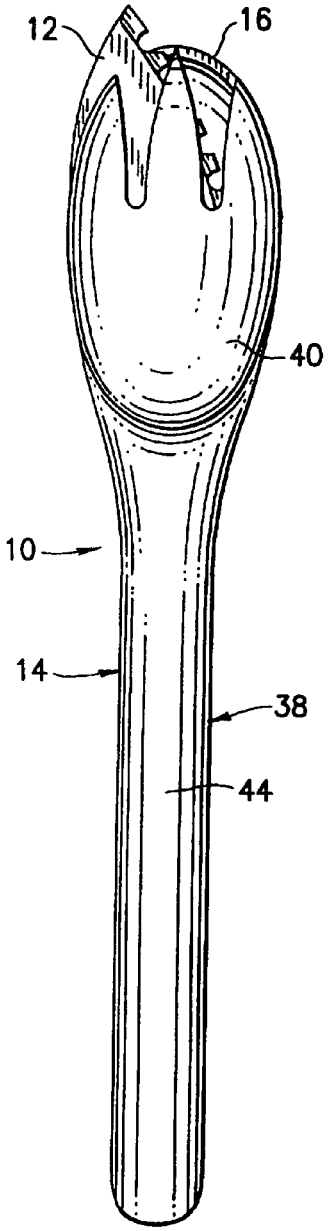
FIG. 6 is a top plan view of the assembly shown in FIG. 5.
Figure 7:
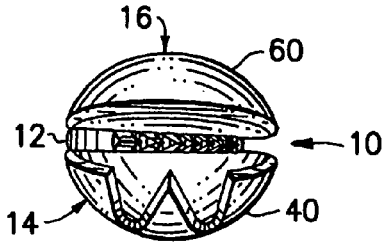
FIG. 7 is an end elevational view of the assembly as viewed from the top end in FIGS. 5 and 6.
Figure 8:
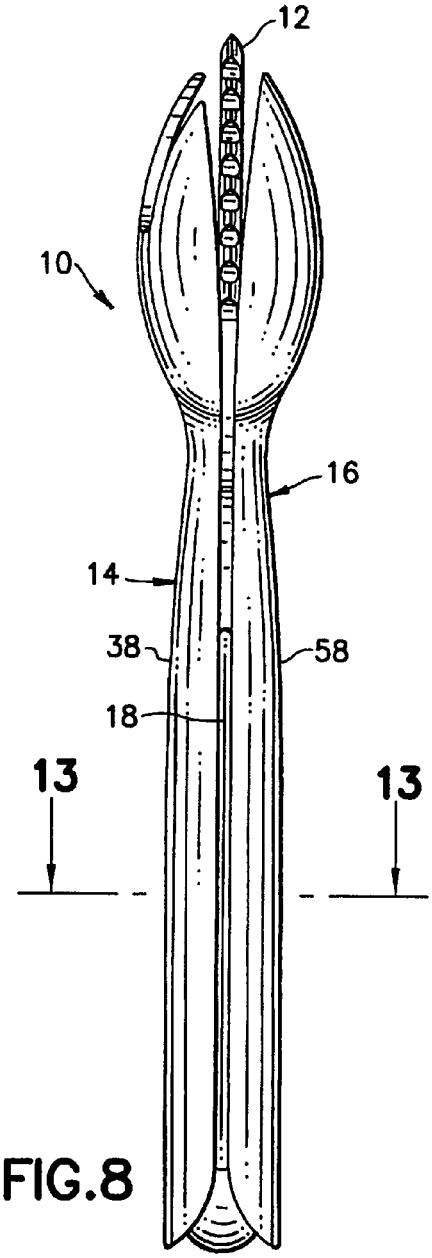
FIG. 8 is a side elevational view of the assembly as viewed from the right side in FIG. 6.
Figure 9:
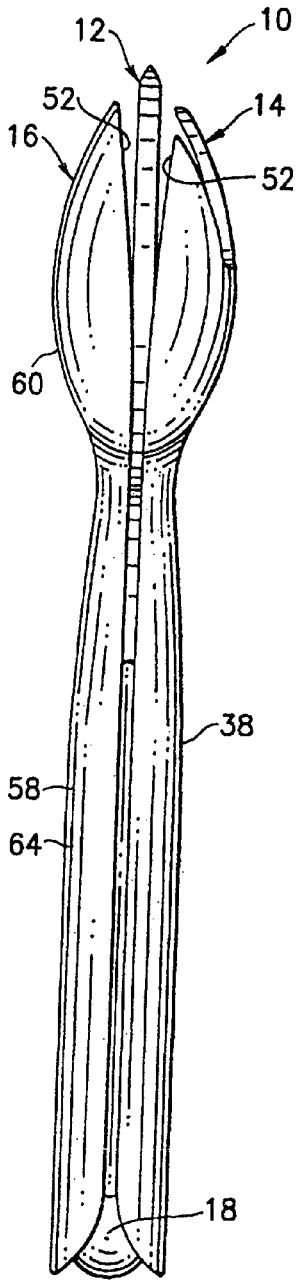
FIG. 9 is a side elevational view as viewed from the left side in FIG. 6.
Figure 10:
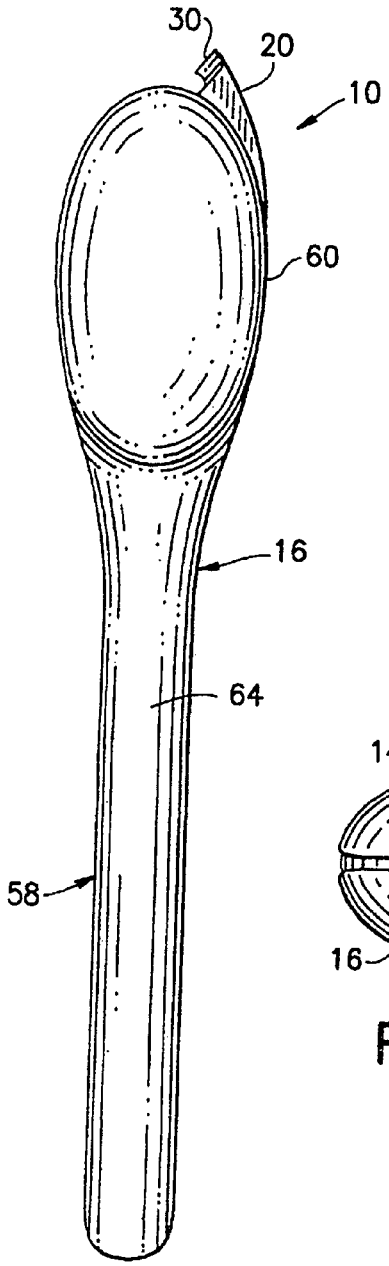
FIG. 10 is a bottom plan view of the assembly.
Figure 11:
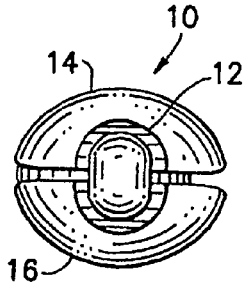
FIG. 11 is an end elevational view of the assembly as viewed from the bottom end in FIG. 6.

An eating utensil assembly in accordance with the subject invention is identified generally by the numeral 10 in FIG. 1. The assembly 10 includes a knife 12, a fork 14 and a spoon 16. The knife 12, fork 14 and spoon 16 each are formed unitarily from a thermoplastic and can be assembled together as shown in FIGS. 6–11 and 13.

Figure 12:
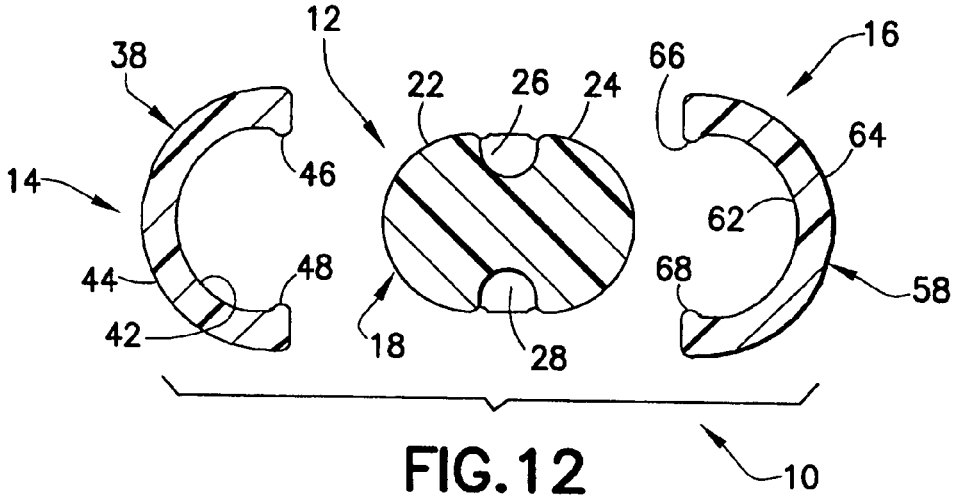
FIG. 12 is an exploded cross-sectional view of the handles of the assembly.

The knife 12 includes an elongate handle 18 and a blade 20. The handle 18 is of elongate generally elliptical cross-section and is dimensioned to facilitate manual gripping and manipulation by a user. As shown most clearly in FIG. 12, the handle 18 of the knife 12 includes first and second generally semi-cylindrical halves 22 and 24 separated from one another by first and second grooves 26 and 28. The grooves 26 and 28 are substantially identical to one another and extend longitudinally along a major portion of the length of the handle 18. Thus, the grooves 26 and 28 are substantially coplanar and symmetrical about a plane disposed centrally between the semi-cylindrical halves 22 and 24 of the handle 18.

The blade 20 is substantially planar and lies in the plane of symmetry of the grooves 26 and 28. One edge of the blade 20 is formed with an array of serrations 30 to facilitate cutting with the plastic knife 12.

The fork 14 includes an elongate generally channel-shaped handle 38 and a working end 40. The handle has opposite concave and convex surfaces 42 and 44 respectively. The concave surface 42 is dimensioned to nest over one of the semi-cylindrical sections 22 and 24 of the handle 18 of the knife 12. The concave surface 42 of the handle 38 of the fork 14 includes opposed ribs 46 and 48 that project towards one another. The ribs 46 and 48 extend along a major portion of the length of the handle 38, but do not exceed the length of the grooves 26 and 28 in the knife. The ribs 46 and 48 are dimensioned to snap into engagement with the grooves 26 and 28 on the handle 18 of the knife 12. The snapped engagement of the ribs 46 and 48 with the corresponding grooves 26 and 28 releasably holds the handle 38 of the fork 14 in nested engagement with the handle 18 of the knife 12.

The working end 40 of the fork 14 includes a concave surface 50 facing in generally the same direction as the concave face 42 of the handle 38. The concave surface 50 of the fork 14 is bounded by an edge 52 that angles slightly away from the plane defined by the edges of the handle 38 of the fork 14. This slight angular offset of the edge 52 ensures that the working end 40 of the fork 14 does not interfere with the blade 20 of the knife 12 when the knife 12 and fork 14 are assembled. The working end 40 of the fork 14 is further characterized by slits 54 that extend from the distal end of the fork 14 towards the handle 38. The slits 54 are configured to define pointed tines 56 that can be used to pierce and engage food items.

The spoon 16 includes a handle 58 and a bowl 60. The handle 58 of the spoon 16 is substantially identical to the handle 38 of the fork 14. More particularly, the handle 58 is substantially channel-shaped and includes a concave face 62 and a convex face 64. Ribs 66 and 68 project towards one another from the edges of the channel-shaped handle 58 and into the channel defined by the concave face 62. The ribs 66 and 68 define a length that does not exceed the length of the grooves 26 and 28 in the handle 18 of the knife. Thus, the ribs 66 and 68 of the handle 58 can be snapped into engagement with the grooves 26 and 28 on the handle 18 of the knife.

Figure 13:
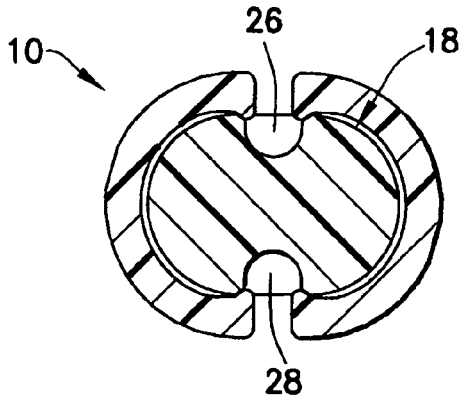
FIG. 13 is a cross-sectional view taken along line 13—13 in FIG. 8.

The ribs 66 and 68 on the handle 58 of the spoon 16 and the ribs 46 and 48 on the handle 38 of the fork 14 are dimensioned to permit simultaneous nested engagement of the fork 14 and spoon 16 around opposite sides of the handle 18 of the knife 12. More particularly, the dimension of the ribs 46, 48, 66, 68 in directions normal to the plane between the ribs 46 and 48 or 66 and 68 is less than one-half the width of the respective grooves 26 and 28. Thus, the ribs 46 and 48 of the fork 14 do not interfere with the ribs 66 and 68 of the spoon 16 when the ribs 46, 48, 66, 68 are snapped into engagement with the grooves 26 and 28, as shown in FIG. 13.

The bowl 60 of the spoon 16 includes a concave face 70 with a peripheral 62. The plan view shape and dimensions of the edge 62 of the spoon 16 are similar to the plan view of the edge 52 of the working end 40 of the fork 14. Thus, the edges 52 and 62 substantially register with one another when the fork 14 and spoon 16 are releasably mounted on opposite sides of the knife 12. The edge 62 of the bowl 60 defines a plane that is angled slightly away from the plane defined by the ribs 66 and 68 to ensure that the bowl 60 of the spoon 16 does not interfere with the blade 20 of the knife 12.

The assembly 10 is used by nesting the handles 38 and 58 of the fork 14 and spoon 16 over the handle 18 of the knife 12. This nesting urges the ribs 46 and 48 of the fork 14 into snapped engagement with the grooves 26 and 28 of the handle 18 on the knife 12. Similarly, the ribs 66 and 68 of the handle 58 of the spoon 16 are snapped into engagement with the grooves 26 and 28 on the handle 18 of the knife 12. Thus, a user can simultaneously grip, carry and manipulate the eating utensil assembly without significant risk of disengagement and without a need to manually exert forces that will hold the utensils together. The assembly 10 is aesthetically attractive and neatly contained with the concave faces 50 and 70 of the working end 40 of the fork 14 and the bowl 60 of the spoon 16 sandwiched around the blade 20 of the knife 12.

The assembly 10 can be used merely by urging the fork 14 and/or the spoon 16 away from the knife 12. Forces exerted on the fork 14 relative to the knife 12 will cause the ribs 46 and 48 on the fork 14 to snap out of engagement with the grooves 26 and 28 on the handle 18 of the knife 12.

Similarly, forces exerted on the spoon 16 cause the ribs 66 and 68 on the spoon 16 to snap out of engagement with the grooves 26 and 28 on the handle 18 of the knife 12. The knife 12, fork 14 and spoon 16 then can be used in the conventional manner. The elongate rounded handle 18 of the knife 12 provides a large convenient gripping area for the knife 12 and enables the knife 12 to be used so that the serrations 30 of the blade 12 can cut through items of food. Similarly, the channel-shaped handles 38 and 58 of the fork 14 and spoon 16 provide large gripping surfaces that can be manipulated easily by a user.

While the invention has been described with respect to a preferred embodiment, it will be apparent that various changes can be made without departing from the scope of the invention. For example, the ribs 46 and 48 are formed on the handle 38 of the fork 14, while ribs 66 and 68 are formed on the handle 58 of the spoon 16. The ribs 46, 48, 66 and 68 snap into engagement with the grooves 26 and 28. However, ribs can be formed on the handle 18 of the knife 12 for engagement with grooves formed in the handles of the fork and spoon.

Efficiencies are achieved by sandwiching the knife 12 between the fork 14 and spoon 16. However, the handles can be configured so that the knife is disposed outwardly from the fork or spoon.

The illustrated embodiment shows three interengageable utensils. However, the invention can be applied to assemble two utensils, such as two forks, or a fork and spoon that may be used for serving food, such as salad. In this situation, one of these two utensils may be formed with grooves, while the other is formed with ribs.

What is claimed is:

1. An eating utensil assembly comprising:

a knife having opposite first and second ends, a blade formed at the first end and a handle extending from the blade to the second end, the handle having opposite surfaces formed with grooves extending along the handle substantially from the blade to a position spaced from the second end of the handle;

a fork having opposite first and second ends, a plurality of substantially concave tines formed adjacent the first end and a concave channel extending from the second end towards the first end, concave surfaces of the tines and the channel facing in a common direction, the concave channel of the fork being configured for nested engagement over the handle of the knife, opposed ribs formed in the concave channel of the fork and configured for releasable snapped engagement with the grooves in the handle of the knife; and a spoon having opposite first and second ends, a concave bowl formed adjacent the first end and a concave channel extending from the second end substantially to the bowl, concave surfaces of the bowls and the channel facing in a common direction, the concave channel of the spoon being configured for nested engagement over the handle of the knife, opposed ribs formed in the concave channel of the spoon and configured for releasable snapped engagement with the grooves in the handle of the knife while the ribs of the fork are in snapped engagement with the grooves in the handled of the knife.

2. The eating utensil assembly of claim 1, wherein the knife, fork and spoon each is formed unitarily from a thermoplastic material.

3. The eating utensil assembly of claim 1, wherein the handle of the knife has an elongated rounded shape.

4. The eating utensil assembly of claim 1, wherein the handle of the knife has a substantially elliptical cross-section.

5. An eating utensil assembly comprising a first eating utensil having an elongate handle with opposite first and second surfaces formed thereon, first and second mounting grooves formed respectively on the opposite first and second surfaces of the handle of the first eating utensil, a second eating utensil having an elongate channel-shaped handle with a concave face configured for nesting over one longitudinal side of the handle of the first eating utensil, first and second mounting ribs formed on the concave face of the second eating utensil, the first and second mounting ribs on the second eating utensil being configured for releasable snapped engagement with portions of the respective first and second mounting grooves on the handle of the first eating utensil, and a third eating utensil having an elongate channel-shaped handle with a concave face configured for nesting over one longitudinal side of the handle of the first eating utensil, third and fourth mounting ribs formed on the concave face of the third eating utensil, the third and fourth mounting ribs on the third eating utensil being configured for releasable snapped engagement with the first and second mounting grooves on the handle of the first eating utensil while the first and second ribs of the second eating utensil are in releasable snapped engagement with the first and second mounting grooves.

6. The eating utensil assembly of claim 1, wherein each of the eating utensils is formed unitarily of a thermoplastic material.

7. The eating utensil assembly of claim 1, wherein the first eating utensil is a knife.

8. The eating utensil assembly of claim 7, wherein the second eating utensil is a spoon.

9. The eating utensil assembly of claim 7, wherein the second eating utensil is a fork.

10. The eating utensil assembly of claim 1, wherein the handle of the first utensil has an elongated rounded shape.

11. The eating utensil assembly of claim 1, wherein the handle of the first eating utensil has a substantially elliptical cross-section.

* * * * *